US006868708B2

(12) United States Patent
Carlsson et al.

(10) Patent No.: US 6,868,708 B2
(45) Date of Patent: Mar. 22, 2005

(54) BLANK GUIDED FORMING

(75) Inventors: Leif Carlsson, Nossebro (SE); Hans Groth, Avesta (SE)

(73) Assignee: Avestapolarit AB (SE)

( * ) Notice: Subject to any disclaimer, the term of this patent is extended or adjusted under 35 U.S.C. 154(b) by 0 days.

(21) Appl. No.: 10/204,926

(22) PCT Filed: Feb. 22, 2001

(86) PCT No.: PCT/SE01/00392

§ 371 (c)(1),
(2), (4) Date: Aug. 22, 2002

(87) PCT Pub. No.: WO01/62406

PCT Pub. Date: Aug. 30, 2001

(65) Prior Publication Data

US 2003/0029216 A1 Feb. 13, 2003

(30) Foreign Application Priority Data

Feb. 22, 2000 (SE) ..... 0000570

(51) Int. Cl.[7] ..... B21D 37/16
(52) U.S. Cl. ..... 72/342.6; 72/342.94; 72/379.2
(58) Field of Search ..... 72/342.1, 342.5, 72/342.6, 342.94, 342.96, 364, 379.2; 219/121.66, 121.73, 121.85

(56) References Cited

U.S. PATENT DOCUMENTS 2,813,049 A * 11/1957 Macutcheon, Jr. ..... 148/650
3,790,744 A 2/1974 Bowen ..... 219/121
3,804,677 A * 4/1974 Swanson ..... 148/564
4,120,187 A * 10/1978 Mullen ..... 72/342.6
5,058,408 A * 10/1991 Leftault et al. ..... 72/56
5,228,324 A * 7/1993 Frackiewicz et al. ..... 72/342.1
5,345,799 A * 9/1994 Miodushevski et al. ..... 72/19.8
5,359,872 A 11/1994 Nashiki ..... 72/9
5,719,374 A * 2/1998 Frackiewicz et al. .. 219/121.66
6,185,977 B1 * 2/2001 Schiessl et al. ..... 72/342.1
6,349,586 B1 * 2/2002 Johnson et al. ..... 72/342.1
6,410,884 B1 * 6/2002 Hackel et al. ..... 219/121.85
6,412,325 B1 * 7/2002 Croswell ..... 72/324
6,415,639 B1 * 7/2002 Kilian et al. ..... 72/342.1
6,601,426 B2 * 8/2003 Wegener ..... 72/294
6,711,929 B2 * 3/2004 Yamaguchi et al. ..... 72/342.1

FOREIGN PATENT DOCUMENTS

| | | |
|---|---|---|
| DE | 19620196 | 11/1997 |
| DE | 19853366 | 5/2000 |
| EP | 0703019 | 3/1996 |
| EP | 1002594 | 5/2000 |

OTHER PUBLICATIONS

International Search Report PCT/SE01/00392 dated May 31, 2001.

* cited by examiner

*Primary Examiner*—Ed Tolan
(74) *Attorney, Agent, or Firm*—Ostrolenk, Faber, Gerb & Soffen, LLP

(57) ABSTRACT

The invention relates to workpiece control shaping of metal, preferably in the form of plates or bands, which metal workpiece has a high tensile limit, preferably about 1000 N/mm$^2$, and is intended to be further shaped. Along predetermined folding notches or zones across the workpiece, the tensile limit of the material is reduced by heating to a tensile limit, which is substantially lower than that of adjacent base material, and when the workpiece has cooled it is subjected to subsequent bending, folding, or shaping operations to provide a two- or three-dimensional shape/extension of the workpiece along the treated folding notches or zones.

8 Claims, 2 Drawing Sheets

BLANK GUIDED FORMING

This application is a 35 USC 371 of PCT/SE01/00392 filed Feb. 22, 2001 which claims priority from Swedish application 0000570-2 filed Feb. 22, 2000.

BACKGROUND OF THE INVENTION

The present invention relates to a blank guided forming or a controlled workpiece shaping of metal, preferably in the form of plates or bands, which metal workpiece has a high tensile limit preferably about 1000 N/mm$^2$ and is intended to be further shaped.

The shaping methods used today are based on the fact that a workpiece, preferably in the form of plates or bands, is shaped a desired shaped in a machine or with a tool, which determines the shape of the final product. The shaping method used may be constituted by rolling shaping, pressing, deep drawing etc. When edge bending/edge folding/edge pressing, it is a combination of tools and machinery settings that decide the shape of the final product. These previously known shaping methods have a plurality of drawbacks and when there is three-dimensional shaping, for example the tools are very expensive. When shaping ultra-high strength materials having a tensile limit that is greater than 10000 N/mm$^2$ the shaping is very difficult to carry out and in particular when it comes to making the shaping with narrow radii in the bending operations edge bending, edge folding and rolling shaping.

SUMMARY OF THE INVENTION

The object of the present invention is to provide a controlled work-piece shaping of metal, preferably in the form of plates or bands, where from a plane or pre-shaped plate workpiece, you can make possible bending or shaping of two- and three-dimensional shapes in a very simple and reproduceable manner. Furthermore, it is very easy by means of the workpiece according to the invention to shape the latter to a final product with relatively simple tool or other devices, and in certain cases when the material is thin wall, by hand. By the invention you can now shape ultra high-strength materials with a tensile limit exceeding 1000 N/mm$^2$ in both two- and three-dimensional shapes, wherein the above enumerated drawbacks are eliminated. The characterizing features of the invention are stated in the accompanying claims.

Thanks to the invention you have accomplished a controlled workpiece shaping of metal workpieces, preferably in the form of plates or bands, which method in an excellent manner fulfills its purpose at the same time as it in addition is both simple and cheap to carry out. With the workpiece according to the invention you can now carry out a further shaping along predetermined folding notches or zones across the workpiece where the yield point of the material through heating is reduced to a yield point which is substantially lower than adjacent base material. The workpiece is now very easy to shape along said folding notches or zones to any desired shape even of a complicated kind. At the same time also rolling shaping and edge folding/edge bending of profiles of material with a tensile limit of above 1000 N/mm$^2$ with very narrow radii. By this enlarged possibility to treat this high strength workpiece the need for welding and expensive follow-up operations are reduced, in particular when there are very sharp bending radii on the piece in question to be produced. Furthermore, during the manufacture you can easily both punch and cut in the workpiece recesses or holes that are to exist in the construction or for later assemblage at the same time as bending can be carried out in optional angles.

BRIEF DESCRIPTION OF THE DRAWINGS

The invention is described in more detail below with the aid of a preferred embodiment example with reference to the accompanying drawings, in which.

DESCRIPTION OF THE PREFERRED EMBODIMENTS

Figure 1:
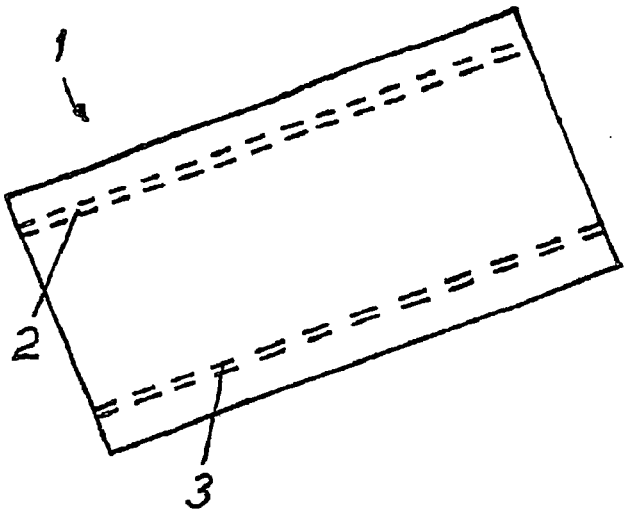
FIG. 1 shows a plane workpiece, which is provided with bending notches according to the invention to accomplish a two-dimensional shape of the final shaped product.
Figure 2:
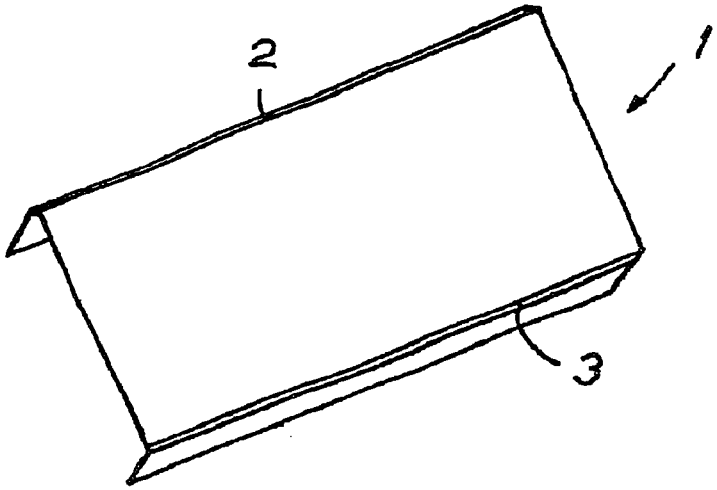
FIG. 2 shows the workpiece in FIG. 1, after that it has been shaped to the pre-determined shape along the bending notches.
Figure 3:
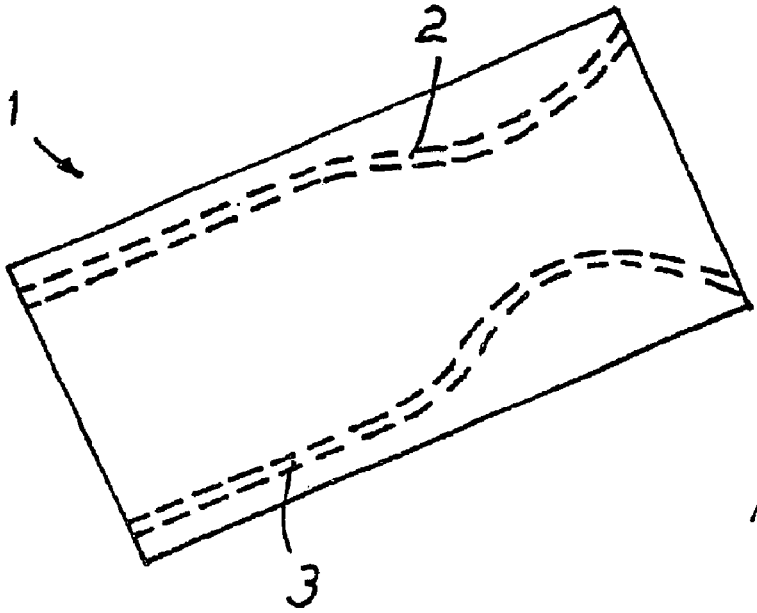
FIG. 3 shows another plane workpiece, which is provided with bending notches according to the invention to accomplish a three-dimensional shape of the finally shaped product
Figure 4:
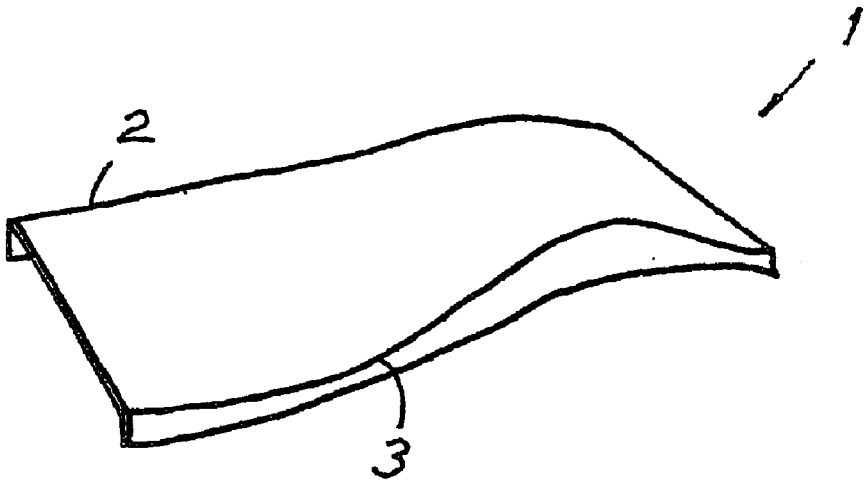
FIG. 4 shows the workpiece in FIG. 3, after that it has been shaped to a pre-determined shape along the bending notches.

The method according to the invention means that you make folding/bending notches 2,3 in a workpiece 1 of plate or band shape consisting of a material with a high tensile limit and preferably about 1000 N/mm$^2$ and which is intended to be further shaped from its original, substantially planar state. Along said folding/bending notches 2,3 or zones across the workpiece, the yield point of the material is reduced by heating to a value, which is substantially lower than the yield point of adjacent base material. Through said treatment of the folding notches or zones 2,3 the workpiece 1 can then subjected to following bending operations. During said operation you shape the plate workpiece 1 in or along the partially heated zones 2,3 and which shaping is made possible thanks to the lower yield point at said folding notches or zones. When the heat treatment has been completed, you permit the material to cool while waiting for coming bending operation.

When the workpiece 1 then has been folded or bent along the heat treated zones 2,3, depending on the direction of the heat treated zones 2,3 which can be straight, curved, formed as a circle segment or extending along an optional curve, the workpiece 1 will bend out of the plane and the entire workpiece 1 then assumes a two- or three-dimensional shape and/or extension. The width of the zones 2,3 is adapted to the bending radius of the workpiece at the zone. The zones 2,3 vary along the longitudinal direction of the workpiece.

According to the invention you have now provided a plane or pre-shaped metallic plate workpiece, which is intended to be further shaped and which has a tensile limit, preferably about 1000 N/mm$^2$ the shape of which can be varied and where you have heated one or more narrow elongated zones to a temperature, so that the properties of the material are changed and you achieve a real reduction of the tensile limit of the material along said zones. The heat treatment of said zones may take place at one- or two-sides of the workpiece, with the aid of a light arc, gas flame, reduction heating, laser, IR, visible or invisible light of all its sorts, hot shoes, induction, etc. The treatment may vary for obtaining a desired variable reduction of the tensile limit of the workpiece and in response to the thickness thereof.

All machining of the workpiece according to the invention takes place in a machine with the aid of any of the above said heating methods and which delivers the final workpiece, which then is to be shaped. The bending radii, to be utilized when shaping the workpiece, is determined by the width of the zone that is heat treated. You may vary the width of the zone in its longitudinal direction, which makes possible the at the radii of one and the same bending or angle can be varied in the length of the bending. By controlling the heating a variation in the reduction of the tensile limit can be achieved and the tensile limit can also be varied in the direction of the thickness of the plate. As previously mentioned the heating method of the folding notches or zones in question can take place with the aid of any of the above enumerated method.

The pattern that the heat treated folding notches or zones form on the plane or preshaped plate workpiece controls the final shape. The workpiece according to the invention is constituted by a metallic material suitable for the object, preferably, a thin wall, ultra-high strength stainless material.

The embodiments of the invention described above may be used separately or in combination with one another.

What is claimed is:

1. A method of workpiece controlled shaping of metal having an initial planar or plate form wherein a workpiece is of metal of an ultra-high strength material and is intended for further shaping, the method comprising:

determining predetermined folding notches or zones across the workpiece when the workpiece is in its substantially planar form;

reducing the tensile limit of the material of the workpiece by heating the workpiece at the notches or zones to a tensile limit substantially lower than the tensile limit of adjacent base material which is not heated;

while the workpiece is not yet reshaped, waiting until the workpiece cools; and after the workpiece cools, subjecting the workpiece to bending, folding or shaping along the heated folding notches or zones of the workpiece to reshape the workpiece into a two or three dimensional shape different from the initial forms;

wherein the bending, folding, or shaping of the workpiece is performed without using a machine or tool that automatically determines and creates the two or three dimensional shape.

2. The shaping method of claim 1, wherein the width of a folding notch or zone of the workpiece to be heated is adapted to a predetermined bending radius of the workpiece at the notch or zone.

3. The method of claim 1, wherein the heat treated zone of the workpiece varies in the longitudinal direction of the workpiece.

4. The method of claim 1, further comprising controlling the heating for obtaining a desired variable reduction of the tensile limit of the workpiece and in response to the thickness of the workpiece.

5. The method of claim 1, wherein the workpiece is of a thin wall, ultra-high strength metal.

6. The method of claim 1, further comprising determining the final shape of the workpiece by establishing a pattern of the heat treated notches and zones in the plate form of the workpiece before heat treating and bending.

7. The method of claim 1, wherein the bending, folding, or shaping of the workpiece is performed using a simple tool.

8. The method of claim 1, wherein the bending, folding, or shaping of the workpiece is performed by hand.

* * * * *